United States Patent [19]

Scarpa et al.

[11] Patent Number: 4,562,692

[45] Date of Patent: Jan. 7, 1986

[54] ACCUMULATING APPARATUS BETWEEN A CARTONER AND A SIDE SEAM GLUER

[75] Inventors: Eric W. Scarpa, Cincinnati, Ohio; David Landsiedel, Lawrenceburg, Ind.

[73] Assignee: R. A. Jones & Co. Inc., Covington, Ky.

[21] Appl. No.: 527,961

[22] Filed: Aug. 31, 1983

[51] Int. Cl.[4] ..... B65B 43/14; B65B 43/34; B65H 31/06; G65G 60/00

[52] U.S. Cl. ..... 53/566; 53/262; 493/8; 493/314; 198/444; 198/462; 271/3.1; 271/214; 414/37; 414/103; 414/110

[58] Field of Search ..... 271/3.1, 201, 214, 215; 198/444, 462; 53/262, 566; 493/314, 8; 414/37, 103, 110

[56] References Cited

U.S. PATENT DOCUMENTS

| | | | |
|---|---|---|---|
| 2,853,298 | 9/1958 | Faeber | 271/87 |
| 3,152,701 | 10/1964 | Wekand | 271/3.1 |
| 3,682,473 | 8/1972 | Kuyt | 271/68 |
| 3,696,474 | 9/1972 | Klappenecker | 271/3.1 |
| 3,728,945 | 4/1973 | Vuilleumier | 493/314 |
| 3,831,784 | 8/1974 | Newell | 414/109 |
| 3,918,704 | 11/1975 | Sugiyama et al. | 271/201 |
| 4,211,054 | 7/1980 | Sramek | 53/502 |
| 4,429,864 | 2/1984 | Scarpa et al. | 271/10 |

OTHER PUBLICATIONS

Brochure of Jagenberg Inc. "High-Speed Folding Carton Gluer" Diana 85-1+Diana 105-1, circa 1981.

*Primary Examiner*—Francis S. Husar
*Assistant Examiner*—William E. Terrell
*Attorney, Agent, or Firm*—Wood, Herron & Evans

[57] ABSTRACT

A cartoner has a side seam gluer for forming flat folded cartons which are vertically oriented in a magazine for feeding into the cartoner. A conveyor having a horizontally-movable discharge chute feeds the flat folded cartons in a vertical orientation onto the feeder. The discharge chute moves horizontally to follow the increasing or decreasing supply of cartons and permits the accumulation of a supply of cartons sufficient to run the cartoner for about two minutes in the event of a jam in the side seam gluer.

5 Claims, 9 Drawing Figures

ACCUMULATING APPARATUS BETWEEN A CARTONER AND A SIDE SEAM GLUER

This invention relates to a cartoner for use with a side seam gluer and more particularly to a device for accumulating an excess capacity of flat folded cartons so as to keep the cartoner operating in the event of a jam in the side seam gluer.

A cartoner generally has a transport conveyor into which erected tubular cartons are fed. A product bucket conveyor runs alongside the transport conveyor and carries product to be thrust into the open end of each cartoner. The cartons and product, in alignment, pass a barrel loader which thrusts the product into the carton.

It is of course desirable to operate as efficiently as possible and that involves decreasing to a minimum the down time of the cartoner as well as running with a minimum of operators. Another aspect of efficiency involves the operation of the cartoner in conjunction with a side seam gluer which is a device for receiving a flat blank and folding and sealing it into a flat tubular carton. It is of course possible to have the cartons folded and sealed outside the cartoning plant and shipped into the cartoning plant in containers which are unloaded by the operator and placed in the cartoner magazine. This adds to the cost of the carton and requires substantially greater storage space adjacent the cartoning apparatus than do the unfolded carton blanks. It is therefore desirable to employ a side seam gluer, particularly with large cartons such as those suitable for breakfast cereals, and to feed cartons formed by it to the cartoner in such a way as to minimize cartoner down time.

One way of eliminating some cartoner down time is to provide excess capacity of cartons at the carton feeder. In one form of the cartoner, the excess capacity permits the cartoner to be run for about two minutes in the event of jam in the side seam gluer. The two minutes should provide ample time for an operator to clear the jam. Thus, there is no cartoner down time arising out of a jam in the side seam gluer.

It would perhaps be easy enough to provide for the excess capacity, but after the cartoner has run some of the excess cartons, the gap between the incoming cartons and the depleted supplies would have to be filled in by hand by an operator.

It has been an objective of the present invention to provide apparatus between the side seam gluer and the cartoner which will automatically accumulate flat folded cartons upstream of the carton feeder, the accumulated cartons being available to keep the cartoner running for a few minutes when the side seam gluer jams. This objective of the invention is attained in part by providing a horizontally-movable discharge chute which receives flat folded carton blanks from the gluer and deposits them in a vertical orientation on the cartoner magazine.

The chute is provided with a sensing mechanism which monitors the contraction or expansion of the supply of cartons and causes the end of the discharge chute to move in one direction if the supply is expanding and in the opposite direction if the supply is contracting.

Three microswitches are provided on the frame which supports the discharge chute. The most remote microswitch is engaged by the discharge chute when the magazine is full. It operates to shut off the side seam gluer as well as all of the conveyor mechanism. The middle microswitch, spaced approximately six inches from the remote microswitch, operates to start the side seam gluer. The third microswitch, located about eighteen inches from the middle microswitch, is engaged by the discharge chute when the supply of cartons in the magazine is almost depleted and operates to stop the cartoner. That eighteen to twenty-four inches of cartons should be sufficient to run the cartoner for about two minutes in the event of a jam in the gluer.

The objectives and features of the invention will become more readily apparent from the following detailed description taken in conjunction with the accompanying drawings in which.

GENERAL ORGANIZATION AND OPERATION

Figure 1:
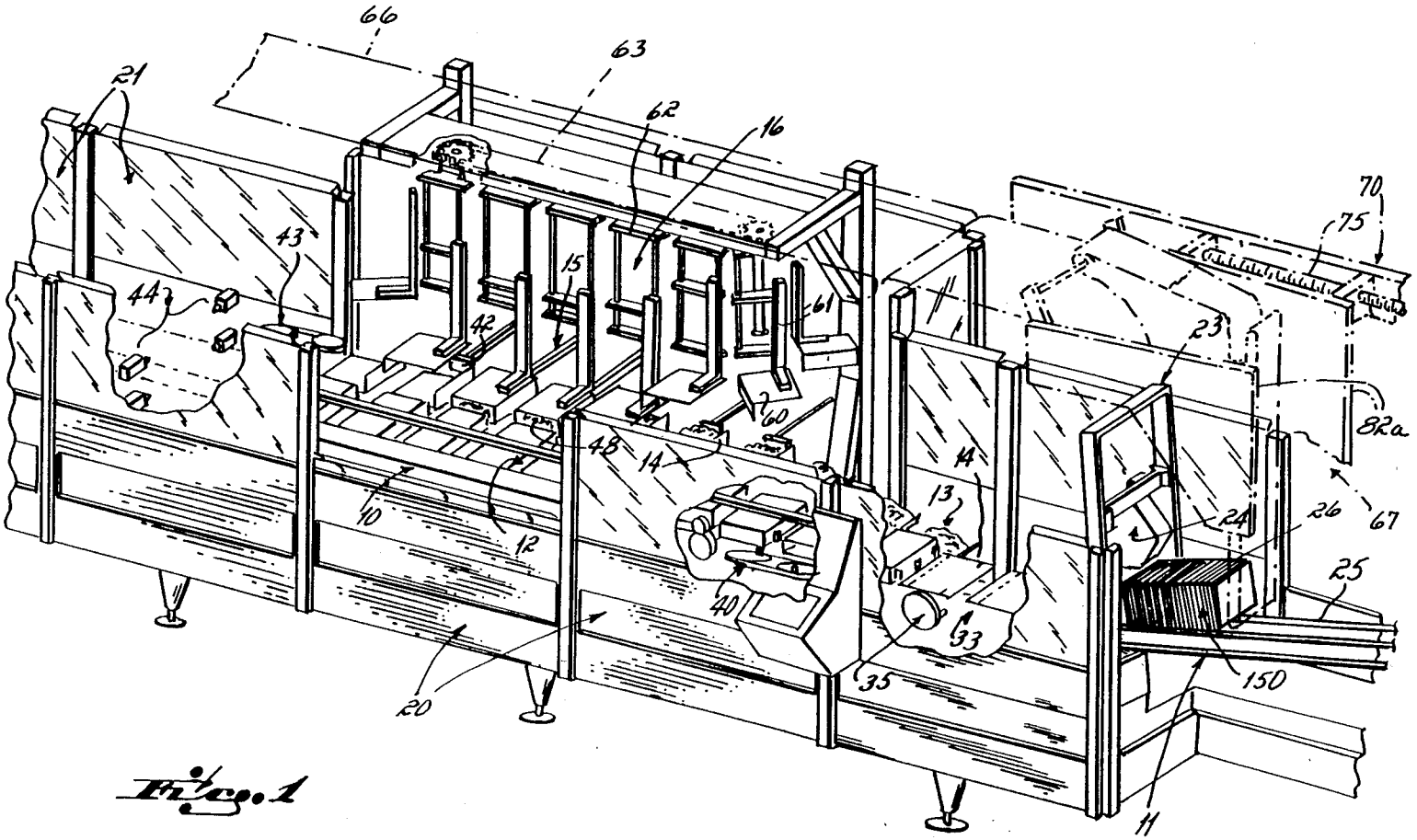
FIG. 1 is a perspective view of a cartoner employing the present invention, the invention being shown in phantom.

A cartoner with which the present invention is employed includes a frame 10 which supports the principal operating elements. The frame supports a carton feeder 11, a carton transport conveyor 12, a product bucket conveyor 13 and product buckets 14 mounted on the conveyor and a barrel loader 15. An overhead tamper confiner 16 is employed for products which must be compressed either vertically or horizontally or both in order to size them for introduction into the cartoner.

The cartoner is surrounded by a series of lower opaque guard panels 20 and guard windows 21 which are capable of being raised and lowered to expose the operating components of the machine for repairs, unclogging jams and the like.

In somewhat more detail, the feeder 11 has a frame 23 which supports a rotatable feed mechanism 24 of the type disclosed in the copending application of Scarpa et al Ser. No. 276,081, filed June 22, 1981. The feeder also includes a pair of spaced parallel upstream chains 25 on which flat folded cartons 26 are supported and gradually moved toward the rotary feeding device. The cartons 26 are fed onto the chains 25, as shown, by an overhead conveyor 66 which receives the cartons from a side seam gluer 65.

The carton transport conveyor 12 has three elongated, parallel endless chains 29. The outboard chains support trailing transport lugs 30. The center chain 31 supports a leading transport lug 32. The center chain may be shifted with respect to the outboard chains in order to vary the spacing between the leading and trailing transport lugs in order to accommodate cartons of differing lengths (the length of the carton is the dimension in the machine direction). The cartons are fed in the flat folded condition onto the transport conveyor. Prior to being captured between the leading and trailing transport lugs of the conveyor 12, the carton is transported from the feeder by a conveyor 33. During the traverse of conveyor 33, the carton flaps are separated by a flap separator 35 which forces a lower flap downwardly into a position where it can be engaged by a stationary plough and turned and held at a 90° angle to the wall to which it is connected. The carton then moves through an air opener 36 which directs blasts of air from either side of the carton in a horizontal direction to force air between the upper and lower walls of the carton, thereby causing the carton to swing to an erect orientation between the leading and trailing lugs of the transport conveyor. That air opener is disclosed in U.S. Pat. No. 3,728,945, issued Apr. 24, 1973.

Immediately downstream of the air opener are opposed flap spreaders 40. The flap spreaders carry lugs 41 which engage the leading flap of the carton and swing it through 90° so that it can be captured by stationary rails and held in that attitude as the carton passes the barrel loader 15. The trailing flap is similarly captured by the rails and held open.

As the carton passes the barrel loader, pusher heads 42 engage products in the product buckets and thrust them across the product buckets into the opened cartons.

After the carton has been filled, it is conveyed past flap closers 43 which engage the trailing flaps and swing them to a closed position. Glue guns 44 are mounted alongside the carton conveyor downstream of the flap closers 43. The glue guns apply an appropriate pattern of glue to one of the horizontal flaps of the carton. When the glue is applied, ploughs swing the horizontal flaps to a closed position and hold them there during the brief period required for the glue to set.

Figure 3:
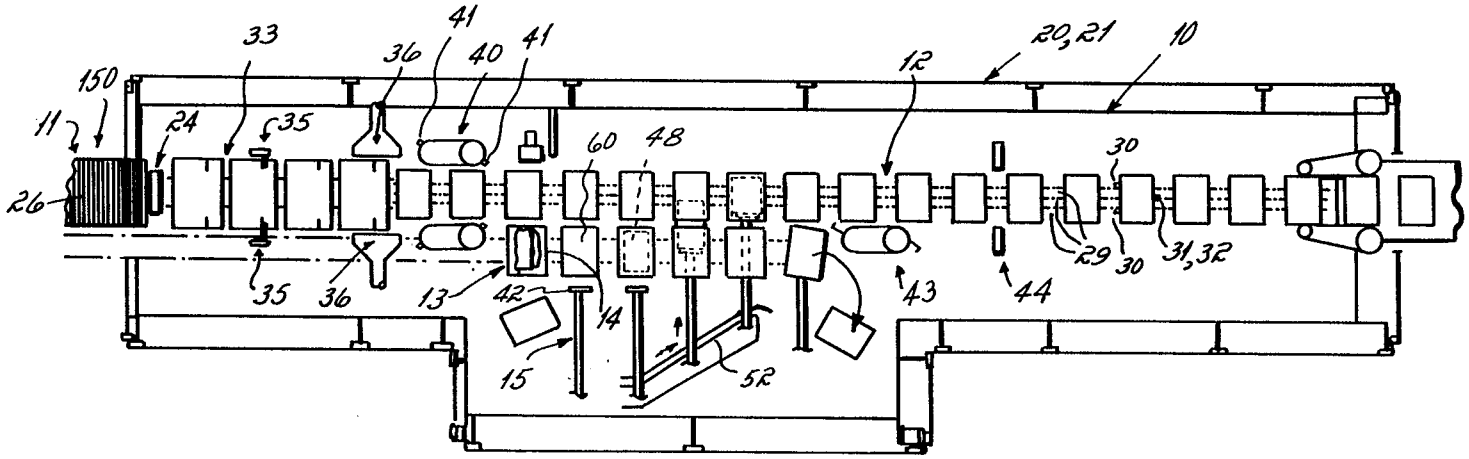
FIG. 3 is a diagrammatic top plan view of the cartoner with the invention removed.

The product bucket conveyor 13 consists of a pair of endless chains which support a series of spaced product buckets 14 which convey products 48 past the open cartons. The product buckets may be L-shaped as shown, or may be U-shaped depending upon the product to be filled into the carton and the need for imparting shaping to the product to enable it to conform dimensionally to the size of the carton. The barrel loader 15 diagrammatically illustrated in FIG. 3 consists of a series of pusher heads 42 which are slidably supported on endless chains. The pusher heads have cam followers which ride in a cam track 52. As the pusher heads are conveyed on the upper run of the chains which support them, the cam track 52 causes each pusher head to move across the product bucket where it engages the product 48 and thrusts it into an open carton.

In the illustrated form of the invention, the tamper confiner 16 has a series of L-shaped tamper confiner elements 60 which are carried by vertical posts 61 and supported on carriages 62. The carriages are connected to endless chains 63 mounted on horizontal sprockets, not shown, to convey the tamper confiner elements over the upper run of the product bucket conveyor adjacent the barrel loader. A cam track 64 is mounted adjacent the path of the posts 61. The posts 61 have followers which ride in the cam track to lower the tamper confiners as they pass over the product buckets and to raise them after the carton has been filled with product by the barrel loader so that they can be swung out of the way of the mechanism during their excursion around to the outside of the cartoner. The L-shaped tamper confiner elements cooperate with the L-shaped product buckets to engage the product such as a breakfast cereal pouch and to shape it into a generally rectangular cross section matching that of the interior of the carton, thereby enabling the pusher heads 42 to thrust the pouch into the cartons. If the product buckets are U-shaped, the tamper confiner may be a flat platen which simply compresses the product as, for example, facial tissues, so that vertical dimension of the product matches the dimension of the carton opening.

Figure 2:
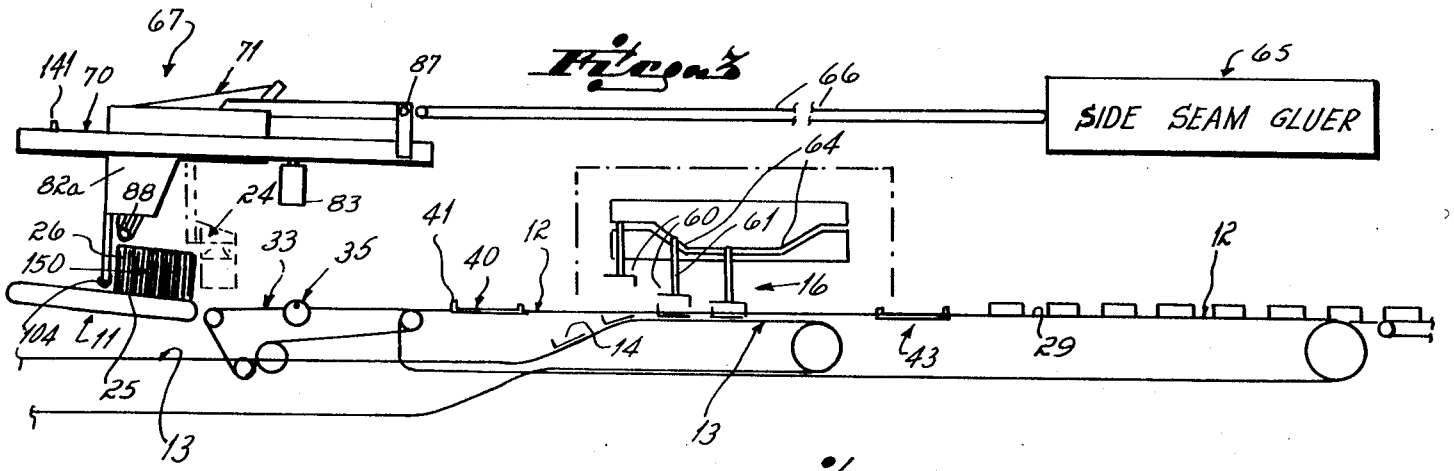
FIG. 2 is a diagrammatic side elevational view of a cartoner employing the invention.

As illustrated in FIG. 2, the cartoner has a side seam gluer 65 which feeds flat folded cartons in shingled fashion on a conveyor 66. At the downstream end of the conveyor 66 is the apparatus 67 for accumulating cartons on the feeder chains 25.

In the operation of the cartoner, the side seam gluer forms the flat folded cartons which are conveyed to the feeder 11. The cartons are fed from the feed mechanism 24 toward the transport conveyor. The upper and lower flaps of the carton are separated so as to permit air to be introduced between the upper and lower walls of the carton. At the air opener 36, blasts of air erect the carton between the leading and trailing transport lugs. As the cartons move downstream, the horizontal flaps are plowed up and down and the vertical flaps are swung through 90° on both sides of the carton to prepare the carton for the introduction of product.

Product which has been transferred to the product buckets is confined by the overhead tamper confiner 16 as the products pass the barrel loader 15. There, the pusher heads 42 of the barrel loader drive each product across the product bucket and into the carton opposite it as the product buckets and transport conveyors move alongside each other past the barrel loader.

After the product has been loaded into the cartons, the carton flaps have a pattern of glue applied to them and are closed and held in a closed condition until the glue sets.

THE ACCUMULATING APPARATUS FOR THE CARTON FEEDER

The elongated overhead conveyor 66 between the side seam gluer 65 and the accumulating apparatus 67 permits the side seam gluer to be located on either side of the cartoning apparatus and at a location where it is least likely to intrude upon the machine operator. The machine operator normally stands at the upstream end of the machine in the position to attend the auxiliary apparatus such as a form, fill, seal machine for packaging breakfast cereals.

Figure 4:
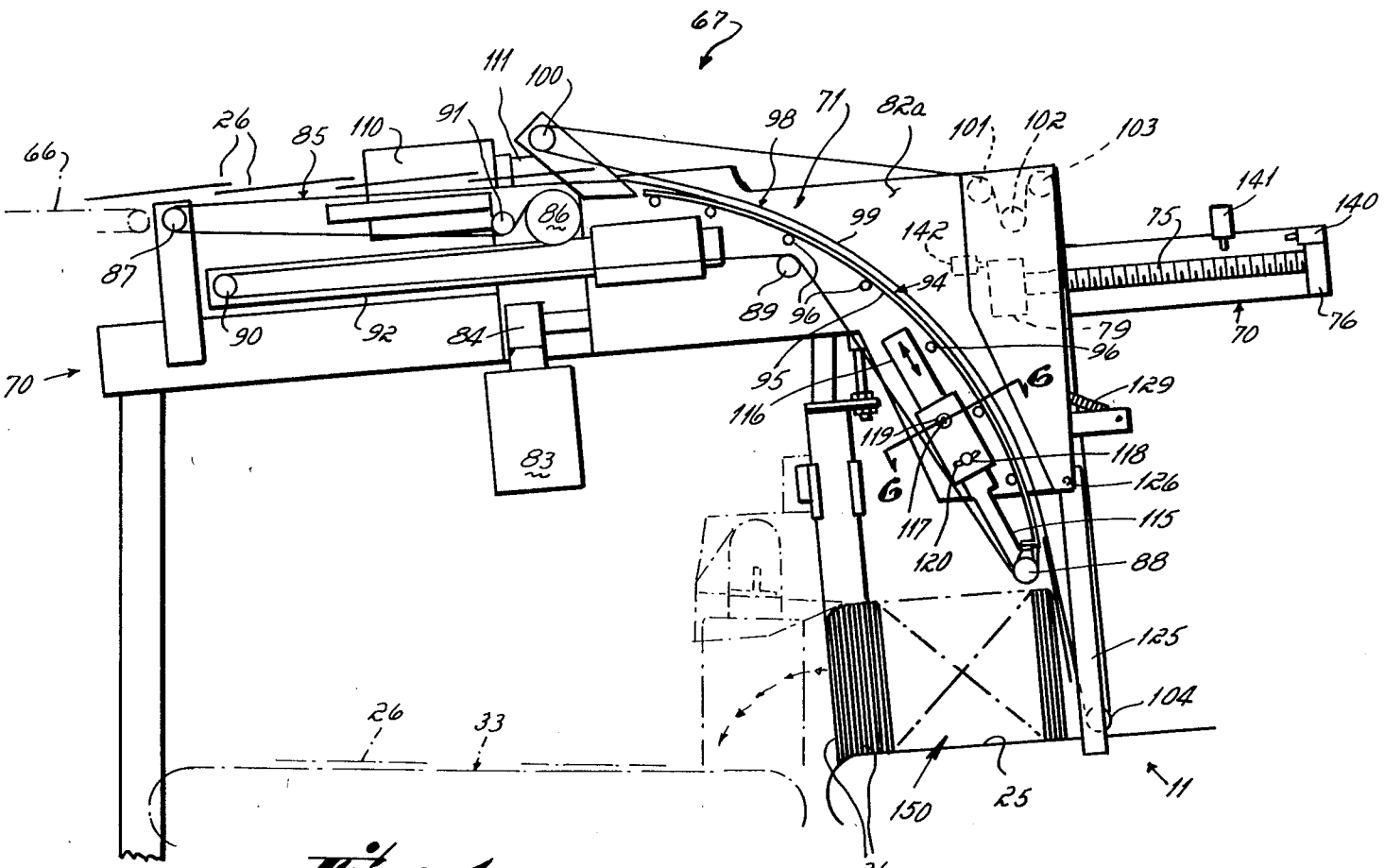
FIG. 4 is a side elevational view of the discharge chute mechanism, as seen from the opposite side with respect to FIG. 2.
Figures 5, 6, 7:
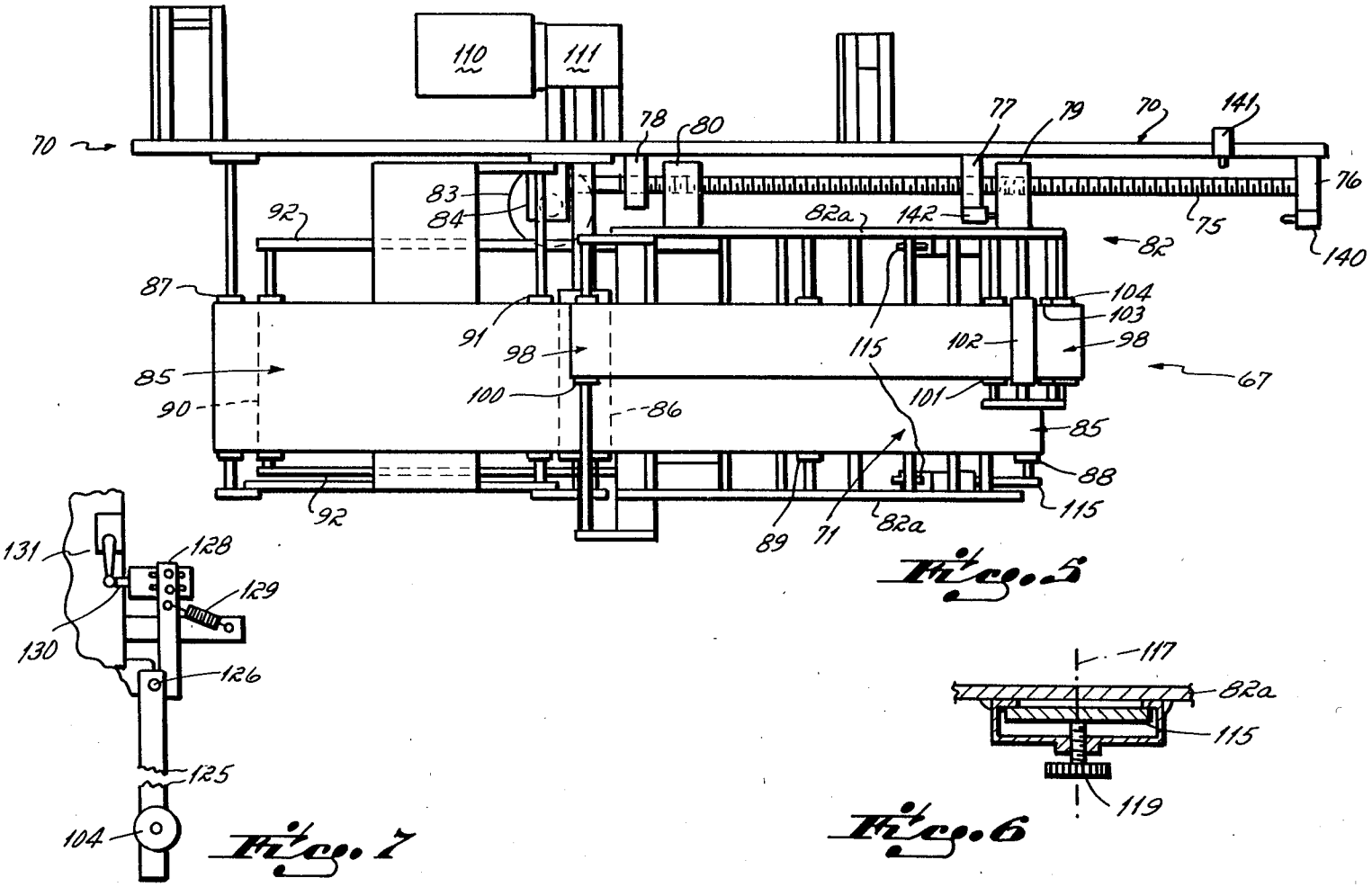
FIG. 5 is a top plan of the discharge chute mechanism.
FIG. 6 is a cross-sectional view taken along lines 6—6 of FIG. 4.
FIG. 7 is an enlarged side elevational view of the supply sensing mechanism.

The overhead accumulating apparatus is best shown in FIGS. 4 and 5. It includes a main frame 70 on which a discharge conveyor 71 is movably mounted. The main frame has a screw 75 rotatably mounted in three bearing blocks 76, 77 and 78. A pair of rotary to linear actuators 79 and 80 engage the screw 75 and as the screw 75 is rotated, the actuators translate the rotary motion of the screw into linear motion of the actuators. The actuators are fixedly mounted to a support 82 which includes two walls **82*a* forming a frame for the discharge conveyor 71. Thus, as the actuators are caused to move linearly, they will carry the support 82** linearly.

The screw 75 is connected to a variable speed reversible dc motor 83 through a gear box 84. The control for the motor 83, to be described below, depends upon the number of cartons in the magazine, whether the cartoner is running, and whether the side seam gluer is running.

The discharge conveyor 71 has a pair of belts which are spaced apart by the thickness of the cartons passing between them in the arcuate operative section of the discharge conveyor. An inner drive belt 85 passes around a drive roll 86 and idler rolls 87, 88, 89 and 90. Still another idler roll 91 is mounted adjacent the drive roll to increase the wrap of the belt around the drive roll. The idler roll 90 is mounted between a pair of arms 92 which are fixed to the movable support 82. Idler roll 87 is fixed to the fixed frame 70 as is the drive roll 86 and the idler roll 91. Idler rolls 88 and 89 are rotatably mounted between the movable support walls 82*a*.

The belt 85 has an arcuate run at 94 which is supported by a sheet of material such as plastic 95, the sheet of material resting on cross members 96 mounted between the movable support walls 82*a*.

The discharge conveyor also includes an outer idler or hold-down belt 98 which also has an arcuate run 99 overlying the arcuate run 94 of the drive belt 85. The idler belt is supported on idler pulleys 100, 101, 102, 103 and 104. The idler pulley 104 is preferably located as close as possible to the feed conveyor 25 for the magazine so as to maintain as good a control as possible over the cartons being fed into the magazine.

The drive belt 85 is driven by a drive motor 110 through a gear box 111. Essentially, the motor 110 will operate when the side seam gluer operates, the side seam gluer being the apparatus which feeds flat folded cartons to the drive belt 85 via overhead conveyor 66.

The discharge conveyor is adapted to handle cartons of different sizes. To this end, it is important to be able to adjust the height of the idler roller 88 above the magazine conveyor 25 so that the lower extremity of the drive belt 85 is located immediately above the top edges of the cartons in the magazine. The idler roller 88 is therefore mounted between a pair of arms 115 which are both slidable in the directions of the arrow 116 and are capable of a slight pivotal movement about an axis 117. The bars 115 are retained in a C-shaped extrusion as shown in FIG. 6. The extrusion has two set screws 118 and 119. The extrusion is pivotally mounted to the movable support 82 about the set screw 119 which provides the pivotal action of the extrusion. The support 82 has an arcuate slot 120 through which the set screw 118 passes. The arcuate slot 120 permits the extrusion to swing through a small arc about the pivot axis 119. Adjustment of the position of the idler roll 88 is made by loosening the two set screws and sliding bars 115 and the roll 88 either up or down depending upon the size of the carton to be accommodated. As the bars are slid, the extrusion is pivoted slightly in order to keep the idler roll 88 adjacent to the idler belt 98. When in the desired position, the set screws are tightened and the assembly will remain fixed in that attitude until another change is required.

On the idler drive belt 98, the lower idler roll 104 is mounted between a pair of depending arms 125, the arms being pivoted at their upper ends at 126 to the movable support 82. As shown in FIG. 7, the arms 125 have an upper extension 128. A tension spring 129 is connected between the upper extension 128 and the support 82 to urge the rollers 104 in a clockwise direction as viewed in FIG. 7. An adjustable block 130 is mounted on the upper extension of the arms and is engageable with the actuator of a microswitch 131. The tension spring urges the lower roller 104 against the stack of cartons in the magazine.

The function of the microswitch 131 is to provide assurance that the roller 104 is in contact with the supply of cartons in the magazine and that contact is maintained at the desired pressure by the operation of the motor 83 which causes the support 82 to move in one direction or the other. For example, if the side seam gluer has stopped and no fresh cartons are being delivered down the discharge conveyor 71, the continued operation of the cartoner will deplete the cartons in the magazine. Hence, the tension spring will cause the arms to pivot in a clockwise direction pulling the block 130 away from the microswitch 131. Thus, when the microswitch is disengaged from the block 130, the microswitch will cause the motor to rotate in that direction which will cause the carriage to move in the direction of the feeder or toward the left as viewed in FIGS. 4 and 5.

On the other hand, when the side seam gluer is operating, it will feed cartons into the magazine faster than the cartoner will use the cartons. The pressure of the incoming cartons on the arms 125 will cause them to swing in a counterclockwise direction as viewed in FIG. 7 and cause the block 130 to engage the microswitch 131. When the microswitch 131 is engaged, it will in turn cause the motor 83 to rotate in that direction which will cause the discharge conveyor to move away from the feeder, that is, to the right as viewed in FIGS. 4 and 5.

The discharge conveyor 71 is additionally controlled by three switches 140, 141, and 142 which are engaged by the discharge conveyor as it moves in and out with respect to the feeder. The outboard or remote switch 140 is operative when engaged to turn off the side seam gluer 65 and the conveyor 66 from the side seam gluer to the discharge conveyor, the conveyor 66 being driven by the motor 110. The nearer switch 141 is operative when engaged to turn on the side seam gluer and the motor 110 for the conveyors. The two switches 140 and 141 control the normal operation of the discharge conveyor. For example, let it be assumed that the cartoner 11 is operating at a rate of 100 cartons per minute and that the side seam gluer is operating at a speed about 10% faster than the cartoner. If the limit switches 140 and 141 are spaced apart about six inches, and if ten cartons will occupy one inch of space on the feeder magazine, between the time the microswitch 141 is operated to turn on the side seam gluer and the time the switch 140 is operated to turn off the side seam gluer, approximately six hundred sixty cartons will be discharged onto the magazine with the cartoner using six hundred of them. The introduction of sixty cartons onto the magazine will cause limit switch 140 to operate to turn off the gluer. That will require about six minutes. After the side seam gluer is turned off, the cartoner will remove the cartons at the rate of 100 per minute so that in about 36 seconds the discharge conveyor would have moved toward the left far enough to engage the microswitch 141. Thus, during the normal operation of the apparatus, there would be the continuous actuation of switches 141 and 140 as described above.

In the event that the side seam gluer failed to operate when the switch 141 is engaged, the discharge conveyor 71 would continue to move toward the feeder until almost all of the supply of cartons is exhausted. At that point, the microswitch 142 would be contacted and that would shut everything down including the cartoner.

OPERATION OF THE ACCUMULATING APPARATUS

In the operation of the accumulating apparatus, the folded cartons are conveyed to the apparatus 67 and discharged at the upstream end of the feeder. If it is assumed that the side seam gluer is running, the microswitch 141 will have been engaged and the support 82 will be moving toward the microswitch 140. Since the gluer is operating at a speed about 10% greater than the cartoner, the supply of cartons 26 shown at 150 will gradually increase. As additional cartons are discharged at the rearward end of the supply, the microswitch 131 associated with the arm 125 will energize the motor 83 to cause the support 82 to move rearwardly. Ultimately, it will engage microswitch 140 which will stop the side seam gluer. When the side seam gluer is stopped, the supply of cartons will contract. As the supply contracts the supply being advanced by the feed conveyor 25, the arm 125 will swing clockwise as viewed in the drawings, operating microswitch 131 in a direction to cause the motor 83 to drive the discharge chute toward the feeder. It will continue to move toward the feeder until the microswitch 141 is engaged. When engaged, the microswitch 141 will cause the side seam gluer to start. The starting and stopping of the gluer machine, as well as the continuous reversing of the discharge chute, occurs continuously throughout the operation of the cartoner, the movement of the discharge chute being approximately six inches.

If the gluer should jam, the supply of cartons would continuously contract until a supply is substantially depleted. Thus, the microswitch 131 operated by the arm 125 would keep the discharge chute moving toward the feeder until it reached a position immediately adjacent the feeder. At that point, the microswitch 142 would be operated in such a manner as to shut down the cartoner.

It will be observed that in all of the operations described, the conveyor 66 and the discharge chute 67 are always full of shingled cartons ready to discharge a carton into the supply as soon as the gluer starts. Thus, there will never be a gap in the flow of cartons between the gluer and the feeder which must be hand filled by the operator.

When the jam in the gluing machine is cleared, it will be started manually and the supply will begin to expand. Substantially simultaneously with the starting of the gluing machine, the cartoner can be started. Again, since the gluing machine runs at a speed approximately 10% faster than the cartoner, the supply will gradually increase until it is brought up to normal operating size.

Figure 9:
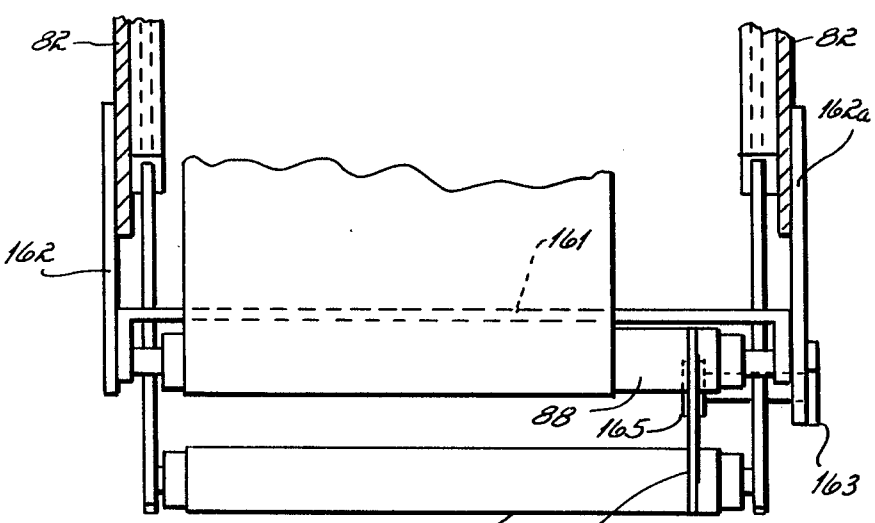
FIG. 9 is a cross-sectional view taken along lines 9—9 of FIG. 8.
Figure 8:
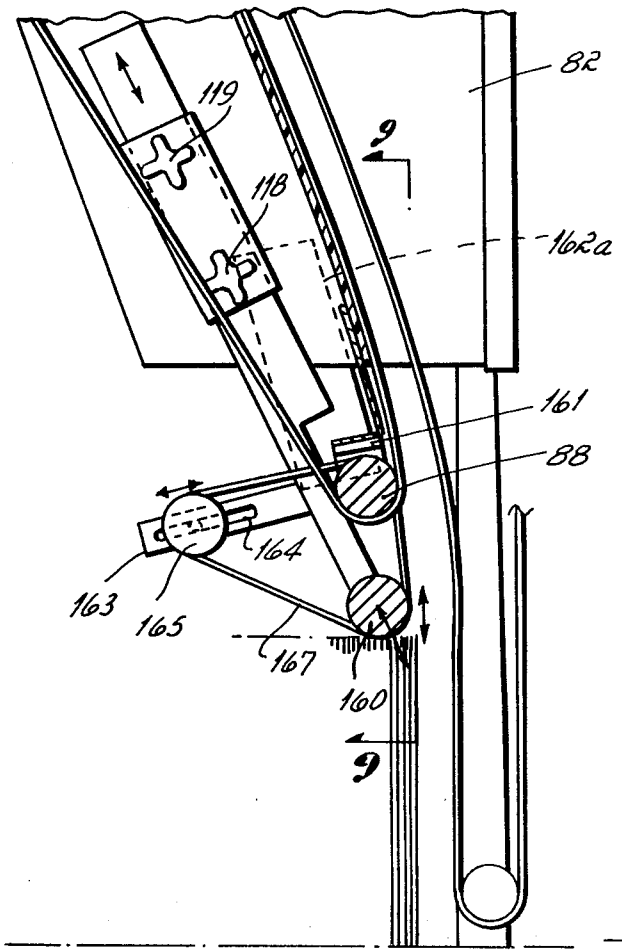
FIG. 8 is a fragmentary side elevational view of a modification of the discharge end of the invention.

It has been found that the making of the adjustment of the position of roller 88 by adjusting the vertical and angular position of the arm 115 in order to change over to a different height carton has been somewhat time-consuming because of the necessity of retracking the drive belt 85. In the modification illustrated in FIGS. 8 and 9, the need for adjustment of the roller 88 has been eliminated. Instead, as best illustrated in FIG. 8, an additional roller 160 is mounted between the arms 115. The roller 88, instead of being mounted on the arms 115, is mounted on a channel-shaped bracket 161, the bracket being mounted on the support 82 by arms 162.

An arm 163 is fixed to one arm 162*a*. The arm 163 has an elongated slot 164 in which a roller 165 is adjustably mounted. A small belt 167 passes around the rollers 88, 160 and 165 to rotate the roll 160 and drive the cartons as they descend into the magazine.

When cartons of different heights are to be run, the changeover at the discharge end of the device is made by loosening the set screws 118 and 119 and raising or lowering the arms 115 to set the roller 160 at a new position immediately above the top edges of the cartons. To accommodate that movement, the roller 165 is adjusted along the length of the slot 164 in order to maintain the proper tension on the belt.

Having described our invention, we claim:

1. In combination with a cartoner having a carton feeder and a side seam gluer having a discharge end above the cartoner and downstream of the carton feeder:

means normally supplying cartons from said side seam gluer faster than said cartoner can erect and fill them, apparatus for conveying flat folded cartons from said gluer to said carton feeder and providing a controlled accumulation of cartons at the feeder which may vary up to about twenty-four inches in a horizontal dimension comprising, a frame, an overhead conveyor mounted on said frame for conveying cartons from said side seam gluer toward said carton feeder, a downwardly-directed discharge chute at the discharge end of said conveyor, a generally horizontal magazine below said discharge chute and adjacent said feeder, said magazine including an endless conveyor for accumulating and carrying generally vertically-oriented cartons to said feeder, means for moving said chute horizontally away from said feeder as the number of cartons in said magazine increases, and toward said feeder as the number of cartons in said magazine diminishes, whereby said side seam gluer can operate continuously while said chute is moving away from said feeder and can shut down completely while said chute is moving toward said feeder, said chute and moving means comprising:

a horizontally-movable support mounted on said frame, an outer endless belt mounted on said support and having an arcuate run extending from said overhead conveyor to said horizontal magazine, an inner endless belt having an arcuate run mounted on said support and extending adjacent to and substantially parallel to the arcuate run of said outer belt, said inner belt having a rearward extension passing over a roll mounted on said frame adjacent said overhead conveyor for incoming cartons, over a forward roll mounted on said frame and over a rearward roll mounted on said support, said rearward extension permitting said support to move back and forth while maintaining said inner belt adjacent the conveyor for incoming cartons, and means connected to one of said rolls for driving said inner belt.

2. The combination of claim 1 further comprising, a lower idler roll adjacent said magazine around which said outer belt passes, said belt and idler roll engaging the upstream cartons in said magazine, a pair of generally vertical arms pivotally mounted on said support and carrying said idler roll, and microswitch means mounted on said support and engageable by said arms to sense pivotal movement of said arms as the supply of cartons in said magazine changes, said microswitch means being operable to control said chute moving means.

3. The combination as in claim 1 in which said inner belt has an idler roll located at the lower end of said arcuate run, a pair of arms adjustably mounted on said support to permit the position of said idler roll to be altered to accommodate cartons of varying sizes.

4. The combination of claim 1 in which said inner belt has an idler roll located at the lower end of said arcuate run, a pair of downwardly-extending arms mounted on the lower end of said support and projecting below said arcuate run, a second roll mounted between said arms and located below said idler roll, means for adjusting the vertical position of said arms, a third roll mounted on said support and defining a triangle with said idler roll and said second roll, and a belt passing around said idler roll, said second roll, and said third roll, whereby the vertical position of said second roll can be adjusted to accommodate different heights of cartons.

5. In combination with a cartoner having a carton feeder and a side seam gluer having a discharge end above the cartoner and downstream of the carton feeder:

means normally supplying cartons from said side seam gluer faster than said cartoner can erect and fill them, apparatus for conveying flat folded cartons from said gluer to said carton feeder and providing a controlled accumulation of cartons at the feeder which may vary up to about twenty-four inches in a horizontal dimension comprising, a frame, an overhead conveyor mounted on said frame for conveying cartons from said side seam gluer toward said carton feeder, a downwardly-directed discharge chute at the discharge end of said conveyor, a generally horizontal magazine below said discharge chute and adjacent said feeder, said magazine including an endless conveyor for accumulating and carrying generally vertically-oriented cartons to said feeder, means for moving said chute horizontally away from said feeder as the number of cartons in said magazine increases, and toward said feeder as the number of cartons in said magazine diminishes, whereby said side seam gluer can operate continuously while said chute is moving away from said feeder and can shut down completely while said chute is moving toward said feeder, a pair of horizontally-spaced microswitches operatively connected to said side seam gluer to start it and stop it, said switches being mounted on said frame in the path of and engageable by said discharge chute, one of said switches near to said discharge chute is operative when engaged to start said side seam gluer, the other of said switches remote from said chute is operative to stop said side seam gluer, a third microswitch inward of said near switch and spaced therefrom a distance to provide a minimum desired accumulation, said third switch being operatively-connected to said cartoner and engaged by said chute to shut said cartoner down when the supply of cartons in said magazine is substantially depleted.

* * * * *